US010968619B2

(12) United States Patent
Harmon

(10) Patent No.: US 10,968,619 B2
(45) Date of Patent: Apr. 6, 2021

(54) ARCHITECTURAL CONSTRUCTION TECHNIQUE

(71) Applicant: David L. Harmon, Saco, ME (US)

(72) Inventor: David L. Harmon, Saco, ME (US)

( * ) Notice: Subject to any disclaimer, the term of this patent is extended or adjusted under 35 U.S.C. 154(b) by 0 days.

(21) Appl. No.: 16/509,899

(22) Filed: Jul. 12, 2019

(65) Prior Publication Data

US 2020/0018057 A1 Jan. 16, 2020

Related U.S. Application Data

(60) Provisional application No. 62/697,808, filed on Jul. 13, 2018.

(51) Int. Cl.

| | |
|---|---|
| ***E04B 1/30*** | (2006.01) |
| ***E04B 1/14*** | (2006.01) |
| ***E04B 1/84*** | (2006.01) |
| ***E04B 1/94*** | (2006.01) |
| ***E04F 15/02*** | (2006.01) |
| ***E04B 5/48*** | (2006.01) |
| ***E04B 1/66*** | (2006.01) |

(Continued)

(52) U.S. Cl.

CPC ..... *E04B 1/14* (2013.01); *E04B 1/30* (2013.01); *E04B 1/66* (2013.01); *E04B 1/84* (2013.01); *E04B 1/88* (2013.01); *E04B 1/941* (2013.01); *E04B 5/48* (2013.01); *E04F 15/02038* (2013.01); *E04F 15/02044* (2013.01); *E04F 15/107* (2013.01); *E04F 2015/02111* (2013.01)

(58) Field of Classification Search

CPC ..... E04F 15/02038; E04F 15/02044; E04F 15/107; E04F 2015/02111; E04F 2015/02116; E04F 2015/02072; E04F 15/085; E04F 15/042; E04F 15/102; E04F 15/02016; E04F 13/0869; E04B 1/14; E04B 1/30; E04B 1/84; E04B 1/941; E04B 5/48; E04B 1/66; E04B 1/88; E04B 2001/2672; E04B 1/26; E04B 5/43; E04B 2/7412; E04C 3/29; B62D 29/002; B62D 25/04

USPC ..... 52/831, 838, 839, 841, 843, 847, 844, 52/845, 846, 783.18, 784.14, 784.15, 52/784.16, 788.1, 790.1, 792.1, 792.11, 52/794.1, 795.1

See application file for complete search history.

(56) References Cited

U.S. PATENT DOCUMENTS 918,643 A * 4/1909 Aylett et al. ..... E04C 3/14 52/841

2,238,514 A * 4/1941 Weeks ..... E04B 1/944 52/506.08

(Continued)

OTHER PUBLICATIONS

Hydrosafe High-Performance Vapour Retarder, Suitable for All Fibrous Insulation Mats and Boards, Intello®, Pro Clima International [Retrieved from Internet on May 20, 2020] https://proclima.com/products/internal-sealing/intello, 7 pages.

(Continued)

*Primary Examiner* — Brent W Herring

(74) *Attorney, Agent, or Firm* — Hamilton, Brook, Smith & Reynolds, P.C.

(57) ABSTRACT

A construction technique, for example for residential, light commercial and multifamily building construction, involving pre-fabricated elements. The elements include prefabricated structural components and prefabricated surface components. A technique of incremental building includes assembling a building structure using these pre-fabricated elements.

13 Claims, 14 Drawing Sheets

(51) Int. Cl.
*E04B 1/88* (2006.01)
*E04F 15/10* (2006.01)

(56) References Cited

U.S. PATENT DOCUMENTS

| | | | | | |
|---|---|---|---|---|---|
| 3,881,292 | A * | 5/1975 | Porter | E04B 1/7612 | 52/461 |
| 3,949,529 | A * | 4/1976 | Porter | E04B 1/7612 | 52/281 |
| 4,329,827 | A * | 5/1982 | Thorn | E04B 7/22 | 52/790.1 |
| 4,658,557 | A * | 4/1987 | Mulford | E04B 2/706 | 52/407.1 |
| 4,683,019 | A * | 7/1987 | Motoki | E04B 1/944 | 106/601 |
| 5,678,381 | A * | 10/1997 | DenAdel | E04C 3/29 | 52/836 |
| 5,966,894 | A * | 10/1999 | Crump, Jr. | E04C 3/29 | 52/404.3 |
| 6,058,673 | A * | 5/2000 | Wycech | E04C 3/29 | 52/834 |
| 6,092,864 | A * | 7/2000 | Wycech | B29C 44/188 | 296/187.02 |
| 6,158,190 | A * | 12/2000 | Seng | E04B 1/24 | 52/309.14 |
| 6,253,524 | B1 * | 7/2001 | Hopton | B29C 44/128 | 296/187.02 |
| 6,341,467 | B1 * | 1/2002 | Wycech | B29C 44/18 | 296/193.06 |
| 6,494,012 | B2 * | 12/2002 | Seng | E04B 1/24 | 52/309.14 |
| 6,588,161 | B2 * | 7/2003 | Smith | E04B 2/702 | 52/223.7 |
| 6,807,789 | B1 * | 10/2004 | Kim | E01D 19/125 | 52/847 |
| 6,896,320 | B2 * | 5/2005 | Kropfeld | B62D 29/002 | 296/146.6 |
| 8,820,034 | B1 * | 9/2014 | Watts | E04C 3/16 | 52/404.1 |
| 9,290,211 | B2 * | 3/2016 | Belpaire | B29C 44/1228 | |
| 9,630,659 | B2 * | 4/2017 | Kurokawa | B62D 29/005 | |
| 9,758,193 | B2 * | 9/2017 | Boettcher | B62D 25/04 | |
| 10,232,886 | B2 * | 3/2019 | Boettcher | B62D 25/025 | |
| 10,240,341 | B2 * | 3/2019 | Dettbarn | C09D 5/185 | |
| 2001/0037621 | A1 * | 11/2001 | Seng | E04B 1/24 | 52/847 |
| 2002/0053179 | A1 * | 5/2002 | Wycech | B62D 29/002 | 52/834 |
| 2015/0135638 | A1 * | 5/2015 | Yang | E04C 3/292 | 52/841 |
| 2015/0376898 | A1 * | 12/2015 | Kreizinger | E04C 2/284 | 52/483.1 |
| 2017/0121965 | A1 * | 5/2017 | Dettbarn | C09K 21/02 | |

OTHER PUBLICATIONS

Weyerhaeuser Wood Products, TJI Joist Benefits [Retrieved from Internet on May 20, 2020] https://www.weyerhaeuser.com/woodproducts/engineered-lumber/tji-joists/, 2 pages.

Max Compact Authentic F-Quality, FunderMax® [Retrieved from Internet on May 20, 2020] https://www.fundermax.at/en/exterior/products/detail/max-authentic-f-qualitaet.html, 4 pages.

Gutex Multitherm®, [Retrieved from Internet on May 20, 2020] https://gutex.de/en/product-range/products/product/gutex-multitherm/, 10 pages.

TimberStrand®, Weyerhaeuser Wood Products, [Retrieved from Internet on May 20, 2020] https://www.weyerhaeuser.com/woodproducts/engineered-lumber/timberstrand-lsl/, 1 page.

Open-Web Trusses, Optimize Over Compromise, RedBuilt [Retrieved from Internet on May 20, 2020] https://www.redbuilt.com/products/open-web-trusses/details/, 3 pages.

ExoAir 110, Tremco Commercial Sealants & Waterproofing, [Retrieved from Internet on May 20, 2020] https://www.tremcosealants.com/markets/commerical/air-barrier-systems/impermeable/sheet-applied-membranes/exoair-110/, 7 pages.

PowerLags®, Structural Wood to Wood Screws for Framing, SPAX U.S., [Retrieved from Internet on May 20, 2020] https://spax.us/products/powerlags, 2 pages.

* cited by examiner

ARCHITECTURAL CONSTRUCTION TECHNIQUE

RELATED APPLICATION

This application claims the benefit of U.S. Provisional Application No. 62/697,808, filed on Jul. 13, 2018. The entire teachings of the above application are incorporated herein by reference.

BACKGROUND

Conventional construction techniques used in residential, light commercial and multifamily buildings can be laborious, expensive and, to some extent, limited in architectural style. Typical construction involves layering of systems and parts in a way that supports many independent trades, which is inherently complicated, time consuming and expensive.

In recent decades, there has been a move towards more environmentally-friendly building, including the net zero building. Low energy standards, such as the Passive House standard, add sophisticated technology based on new building science to create more energy conservative buildings. Such standards include low energy metrics, for example involving mechanical ventilation, air tight windows and doors, air barriers and vapor barriers, and high insulation. However, these requirements add cost, complications and time to the building process.

Prefabricated buildings typically involve the same process as is used in conventional on-site building construction, albeit with some improvements in efficiency by virtue of factory production. Conventional construction of a high standard, regardless of whether it is performed in the factory or on the job site, can involve as many as nine or more construction layers, for example a natural lime plaster interior layer, a drywall layer, a high density cellulose layer, a plywood layer, an air barrier layer, joists, thermal barriers, rain screens, and siding.

Combining conventional construction with low energy directives and technology creates further difficulties in design and construction. Deviations from the Passive House standard are often used for architectural reasons, making Passive House construction difficult to implement.

There is, therefore, a need for a new structural solution for construction of residential, light commercial, multifamily and other buildings that is less expensive and labor intensive than conventional techniques and promotes flexibility in architectural design.

SUMMARY

In accordance with an embodiment of the invention, there is provided a construction technique, for example for residential, light commercial and multifamily building construction, involving pre-fabricated elements. The elements include prefabricated structural components and prefabricated surface components. A technique of incremental building includes assembling a building structure using these pre-fabricated elements.

In accordance with one embodiment of the invention, there is provided a prefabricated structural component for construction of a building. The prefabricated structural component comprises a first joist comprising a substantially planar central web section, the central web section being joined at a first edge by a first flange oriented perpendicular to the central web section, and the central web section being joined at a second edge by second flange oriented perpendicular to the central web section. A first air barrier gasket is on an exterior edge of the first flange of the first joist, the exterior edge of the first flange being opposite to an interior edge of the first flange that is joined to the central web section. A second air barrier gasket is on an exterior edge of the second flange of the first joist, the exterior edge of the second flange being opposite to an interior edge of the second flange that is joined to the central web section. A second joist is perpendicular to the central web section of the first joist and attached by a first flange of the second joist to the central web section of the first joist. The second joist further includes a second flange, the first flange and second flange of the second joist being perpendicular to a substantially planar central web section of the second joist. An exterior finish layer is mounted to an exterior edge of the second flange of the second joist, and is oriented in a direction perpendicular to the central web section of the second joist and parallel to the central web section of the first joist.

In further, related embodiments, the prefabricated structural component may further comprise thermal insulation in at least one space between the central web section of the first joist, the central web section of the second joist and the exterior finish layer. The prefabricated structural component may further comprise a lag screw extending through the at least one flange of the first joist and into a flange of a joist of a neighboring prefabricated structural component to secure the prefabricated structural component to the neighboring prefabricated structural component. The lag screw may be positioned and operatively installed to compress the air barrier gasket on the exterior edge of at least one of the flanges of the first joist to create a seal between the first joist and the joist of the neighboring prefabricated structural component. The prefabricated structural component may comprise a wall element. The prefabricated structural component may comprise a column or a beam of an architectural structure. More than one prefabricated structural components may together form an opening for at least one of a window and a door. The first air barrier gasket and the second air barrier gasket may each comprise a portion of an encapsulating air barrier gasket surrounding at least the first joist and the second joist. The prefabricated structural component may further comprise a pickup coupling for a telescopic handler. The exterior finish layer may comprise a bulk water control layer. The first air barrier gasket and the second air barrier gasket may each comprise an air and vapor control layer. The prefabricated structural component may comprise at least one of fire control materials and acoustic control materials.

In another embodiment according to the invention, there is provided a prefabricated surface component for construction of a building. The prefabricated surface component comprises an oriented strand board undersurface layer extending in an elongated dimension to form a plank; a top seal gasket layer on a top surface of the undersurface layer; a first edge seal gasket layer on a first side edge of the undersurface layer; a second edge seal gasket layer on a second side edge of the undersurface layer; and a surface finish layer mounted to the top seal gasket layer of the top surface of the undersurface layer.

In further, related embodiments, the surface finish layer may comprise a floor finish, and the oriented strand board undersurface layer may comprise a subfloor layer. One or more of the first edge seal gasket layer and the second edge seal gasket layer may be compressed against a neighboring prefabricated surface component. The prefabricated surface component may further comprise a surface interlock feature configured to interlock with a corresponding surface interlock feature of the neighboring prefabricated surface component. A lag screw may attach the undersurface layer to a truss or a beam in a floor. The surface finish layer may comprise at least one of: a hardwood floor; a porcelain tile; a stone tile; a cement board; a polymer deck; insulation; an exterior finish; and a roof element. The prefabricated surface component may define an opening for at least one of an electrical component, a lighting component, a ventilation component, a heating component and a plumbing component to penetrate into or through the prefabricated surface component. The prefabricated surface component may further comprise the at least one of the electrical component, lighting component, ventilation component, heating component, or plumbing component installed within the opening in the prefabricated surface component. The prefabricated surface component may further comprise a truss joist attached to the prefabricated surface component. The first edge seal gasket layer, the second edge seal gasket layer, and the top seal gasket layer may each comprise a portion of an encapsulating air barrier gasket surrounding at least the oriented strand board undersurface layer. The prefabricated surface component may further comprise a pickup coupling for a telescopic handler. The top seal gasket layer, the first edge seal gasket layer, and the second edge seal gasket layer may each comprise an air and vapor control layer. The prefabricated surface component may further comprise at least one of a thermal control layer and an acoustic control layer. The prefabricated surface component may comprise a fire control material.

In another embodiment according to the invention, there is provided a method of assembling an architectural structure. The method comprises forming an exterior shell of the architectural structure by compressing air barrier gaskets between modular increments of the exterior shell of the architectural structure, the modular increments of the exterior shell comprising prefabricated structural components; and forming an interior surface of the architectural structure by compressing air barrier gaskets between modular increments of the interior surface of the architectural structure, the modular increments of the interior surface comprising prefabricated surface components.

In further, related method embodiments, the prefabricated structural components may each comprise: a first joist comprising a substantially planar central web section, the central web section being joined at a first edge by a first flange oriented perpendicular to the central web section, and the central web section being joined at a second edge by second flange oriented perpendicular to the central web section; a first air barrier gasket on an exterior edge of the first flange of the first joist, the exterior edge of the first flange being opposite to an interior edge of the first flange that is joined to the central web section; a second air barrier gasket on an exterior edge of the second flange of the first joist, the exterior edge of the second flange being opposite to an interior edge of the second flange that is joined to the central web section; a second joist, perpendicular to the central web section of the first joist and attached by a first flange of the second joist to the central web section of the first joist, the second joist further including a second flange, the first flange and second flange of the second joist being perpendicular to a substantially planar central web section of the second joist; and an exterior finish layer, mounted to an exterior edge of the second flange of the second joist, and being oriented in a direction perpendicular to the central web section of the second joist and parallel to the central web section of the first joist. The prefabricated surface components may each comprise: an oriented strand board undersurface layer extending in an elongated dimension to form a plank; a top seal gasket layer on a top surface of the undersurface layer; a first edge seal gasket layer on a first side edge of the undersurface layer; a second edge seal gasket layer on a second side edge of the undersurface layer; and a surface finish layer mounted to the top seal gasket layer of the top surface of the undersurface layer.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

A description of example embodiments follows.

An embodiment according to the invention provides a new building system for residential, multifamily and light commercial buildings. Multifunction building blocks are prefabricated to accelerate construction and dramatically reduce the construction schedule and labor cost for buildings. Such hybrid elements can include hybrid wall blocks, hybrid floor planks, hybrid floor beams, attached truss joists, additional integrated parts, and other components described herein. Advantages of hybrid elements, in accordance with an embodiment of the invention, can include one or more of the following. A full and complete wall or floor, or floor system, can be placed in one step. Adjustable wall blocks can include membranes and insulation to meet the requirements of all climate zones, including very cold, humid, hot and temperate climates. The conventional use of materials and the standard construction process involving successive trades is dramatically disrupted, thereby bringing high efficiency to site building. Other advantages are taught herein.

Figure 1:
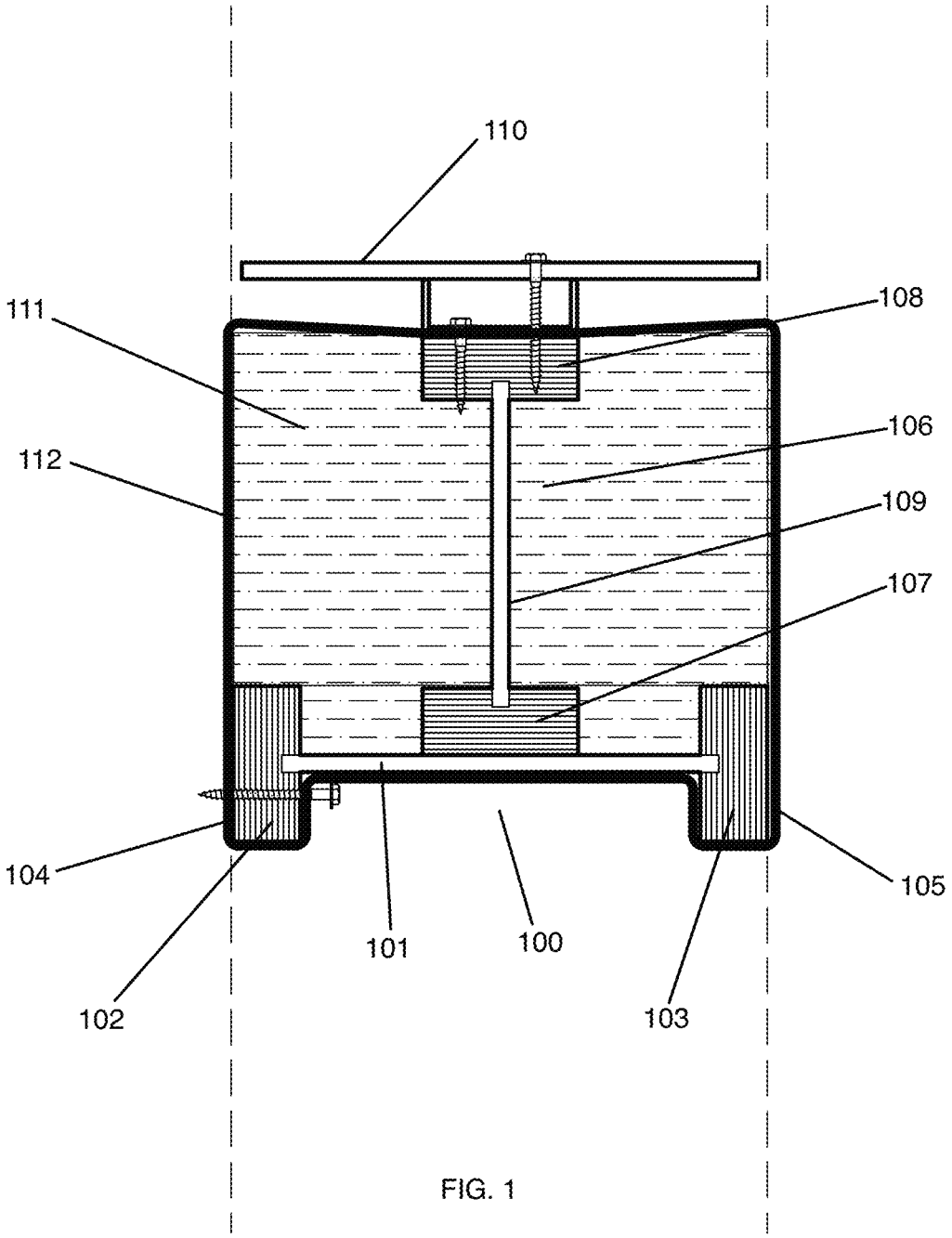
FIG. 1 is an assembled view schematic diagram of a prefabricated structural component for construction of a building, in accordance with an embodiment of the invention.
Figure 2:
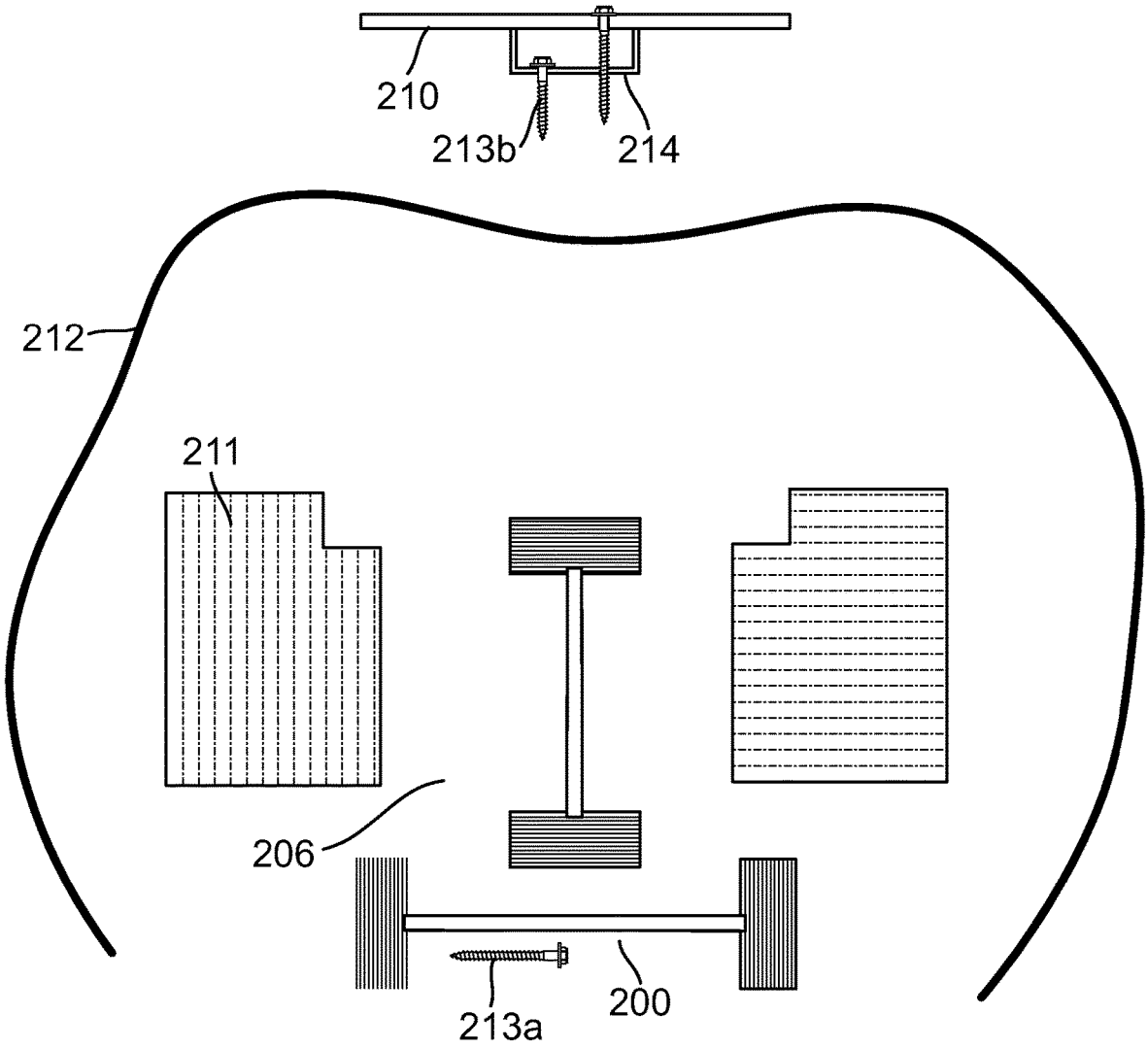
FIG. 2 is an exploded view schematic diagram of a prefabricated structural component for construction of a building in accordance with an embodiment of the invention.
Figure 3:
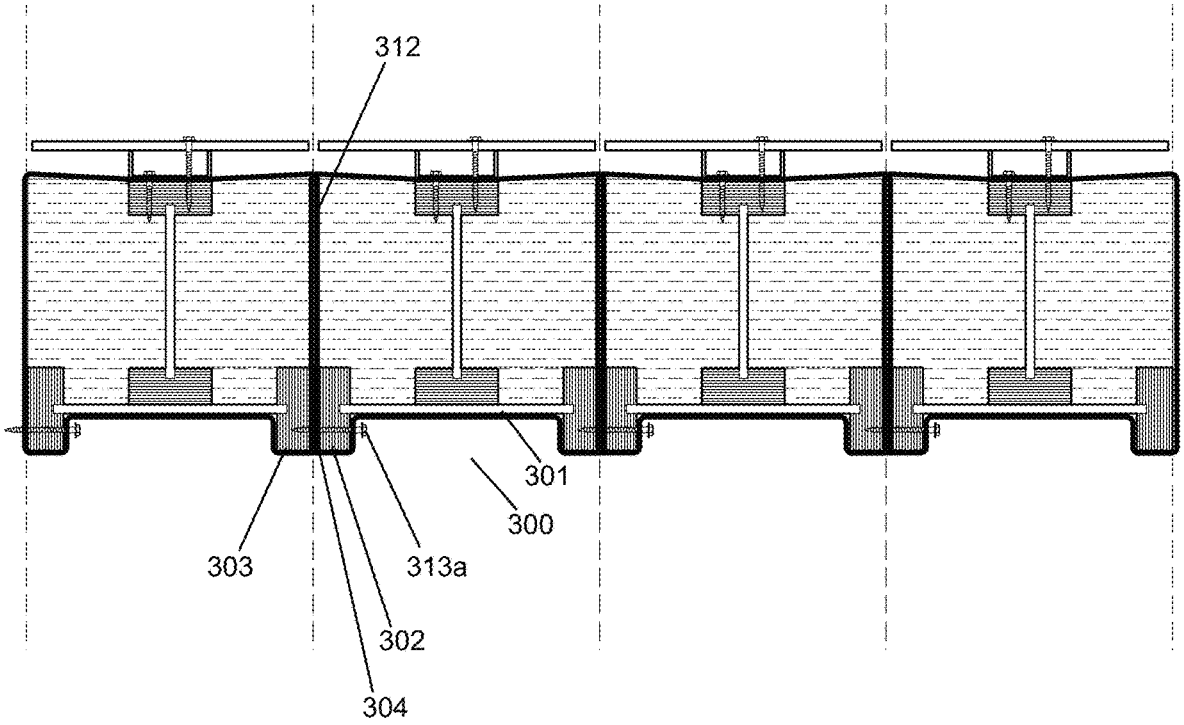
FIG. 3 is a schematic diagram showing prefabricated structural components assembled together, in accordance with an embodiment of the invention.

FIG. 1 is an assembled view schematic diagram, and FIG. 2 is an exploded view schematic diagram, showing components of a prefabricated structural component for construction of a building, such as a hybrid passive house building block, in accordance with an embodiment of the invention. FIG. 3 is a schematic diagram showing such prefabricated structural components assembled together, in accordance with an embodiment of the invention. The building block provides a one-step solution to create, for example, a complete Passive House grade wall, or other wall. Each block is an integrated structure providing a complete wall solution, and can include, for example: insulation, exterior finish, acoustic control, fire control, air barrier layer, vapor barrier layer, water barrier and thermal layers. In more detail, with reference to FIGS. 1 and 2, the prefabricated structural component includes a first joist 100 comprising a substantially planar central web section 101, the central web section 101 being joined at a first edge by a first flange 102 oriented perpendicular to the central web section 101, and the central web section 101 being joined at a second edge by a second flange 103 oriented perpendicular to the central web section. A first air barrier gasket 104 is on an exterior edge of the first flange 102 of the first joist 100, the exterior edge of the first flange 102 being opposite to an interior edge of the first flange 102 that is joined to the central web section 101. A second air barrier gasket 105 is on an exterior edge of the second flange 103 of the first joist 100, the exterior edge of the second flange 103 being opposite to an interior edge of the second flange 103 that is joined to the central web section 101. The first air barrier gasket 104 and the second air barrier gasket 105 can, for example, each comprise an air and vapor control layer, such as a compressible membrane; for example, a foam backed membrane can be used, such as a pro clima® membrane sold by MOLL Bauökologische Produkte GmbH of Schwetzingen, Germany. Further, the first air barrier gasket 104 and the second air barrier gasket 105 can each comprise a portion of an encapsulating air barrier gasket 112 surrounding at least the first joist and the second joist 106, which can, for example, be made of such foam backed membrane materials. In an embodiment, the encapsulating air barrier gasket 112 can surround each component of the prefabricated structural component except the exterior finish layer 110 and components for attaching it to the prefabricated structural component. In another embodiment, the first air barrier gasket 104, second air barrier gasket 105 or an encapsulating air barrier gasket 112 can be or include a liquid applied air barrier film. In addition, the prefabricated structural component comprises a second joist 106, perpendicular to the central web section 101 of the first joist 100 and attached by a first flange 107 of the second joist 106 to the central web section 101 of the first joist 100, the second joist 106 further including a second flange 108, the first flange 107 and second flange 108 of the second joist 106 being perpendicular to a substantially planar central web section 109 of the second joist 106. The structure of the first joist 100 and the second joist 106 is an "I-joist" shape (for example, as can be seen in the "I" shape formed by the flanges 102 and 103 on each side of the central web section 101 of the first joist 100). By using such an "I-joist" shape in two perpendicular axis directions, the prefabricated structural component has two axis column strength that is useful for a structural component of a building, such as an exterior wall. In one example, the first joist 100 and the second joist 106 can be or include a TrusJoist® TJI® Joist sold by Weyerhaeuser of Seattle, Wash., U.S.A., or a portion of such a joist. An exterior finish layer 110 is mounted to an exterior edge of the second flange 108 of the second joist 106, and be oriented in a direction perpendicular to the central web section 109 of the second joist 106 and parallel to the central web section 101 of the first joist 100. The exterior finish layer 110 can, for example, comprise a bulk water control layer. For example, the exterior finish layer 110 can comprise a high pressure laminate, such as FunderMax Exterior, F-Quality, sold by FunderMax Holding AG of Wiener Neudorf, Austria. In some embodiments, an interior finish layer (not shown) may be mounted to an interior edge of the prefabricated structural component, opposite from a side of the central web section 101 to which the second joist 106 is attached, and be oriented in a direction perpendicular to the central web section 109 of the second joist 106 and parallel to the central web section 101 of the first joist 100.

In addition, in the embodiment of FIG. 1, the prefabricated structural component further comprises thermal insulation 111 in at least one space between the central web section 101 of the first joist, the central web section 109 of the second joist 106 and the exterior finish layer 110. The thermal insulation 111 can, for example, comprise wood fiber thermal insulation, such as a Gutex® Multitherm® wood fiberboard insulation, sold by H. Henselmann GmbH+Co KG of Waldshut-Tiengen, Germany. In another embodiment, the thermal insulation 111 can, for example, comprise an insulation bag and a fill valve, which permits inflating of the insulation bag at the site. The prefabricated structural component can comprise one or more of fire control materials and acoustic control materials. For example, one or more, or all of the components of the prefabricated structural component can comprise or be made of fire safety rated materials satisfying relevant building codes in a locality in which a building is built, or one or more fire safety standards.

The exploded view of the embodiment of FIG. 2 shows the components of the prefabricated structural component of FIG. 1, separately, such as the exterior finish layer 210, the encapsulating air barrier gasket 212, the thermal insulation 211, the first joist 200, and the second joist 206. As will be described with reference to FIG. 3, lag screws 213*a* are used to attach the prefabricated structural component to a neighboring prefabricated structural component. In order to attached the exterior finish layer 210, attachment components can be used, such as lag screws 213*b* and a metallic "U"-shaped bracket 214, where the lag screws 213*b* can extend through the encapsulating air barrier gasket 212 and into the second flange 108 (see FIG. 1) of the second joist 206.

As shown in the embodiment of FIG. 3, the prefabricated structural component can be assembled to a neighboring prefabricated structural component using a lag screw 313*a* extending through at least a portion of at least one of the flanges 302 of the first joist 300 and oriented at angles between parallel and perpendicular to a plane of the central web section 301 of the first joist 300 (for example, in FIG. 3, the lag screw 313*a* is parallel to the central web section 301). The lag screw 313*a* can extend through the at least one flange 302 of the first joist 300 and into a flange 303 of a joist of a neighboring prefabricated structural component to secure the prefabricated structural component to the neighboring prefabricated structural component. The lag screws 313*a* can be positioned and operatively installed to compress the air barrier gasket 304 on the exterior edge of at least one of the flanges 302 of the first joist 300 to create a seal between the first joist 300 and the joist of the neighboring prefabricated structural component. Where the air barrier gasket 304 is part of a single encapsulating air barrier gasket 312, the encapsulating air barrier gasket 312 can, for example, be compressed against the encapsulating air barrier gasket of the neighboring prefabricated structural component to create a seal, for example using one or more lag screws 313*a*. FIG. 3 represents, in a plan view, a continuous assembled line of prefabricated structural component screwed together. In such a fashion, incremental, modular prefabricated structural components of an architectural structure can be assembled together. The use of lag screws 313*a* and sealed air gaskets 312 around the prefabricated structural components permits both ease of installation and an energy efficient architectural structure.

In embodiments, the prefabricated structural components can be assembled in a variety of different possible heights, and with different exterior finish layer surfaces attached. In addition, added structures, such as added steel structures, can be used on or inside the prefabricated structural components to create moment frames and stronger connections between parts. Further, metal or plastic straps can be used to maintain the position of thermal insulation 111 (see FIG. 1). The thermal insulation 111 can, for example, also be cellulose, fiberglass, or another insulation material. In addition, further weather resistant barriers, air control barriers, vapor control barriers, and sound control barriers can optionally be used. A variety of different possible depths of the prefabricated structural component can be used to accommodate different insulation requirements.

Figure 4:
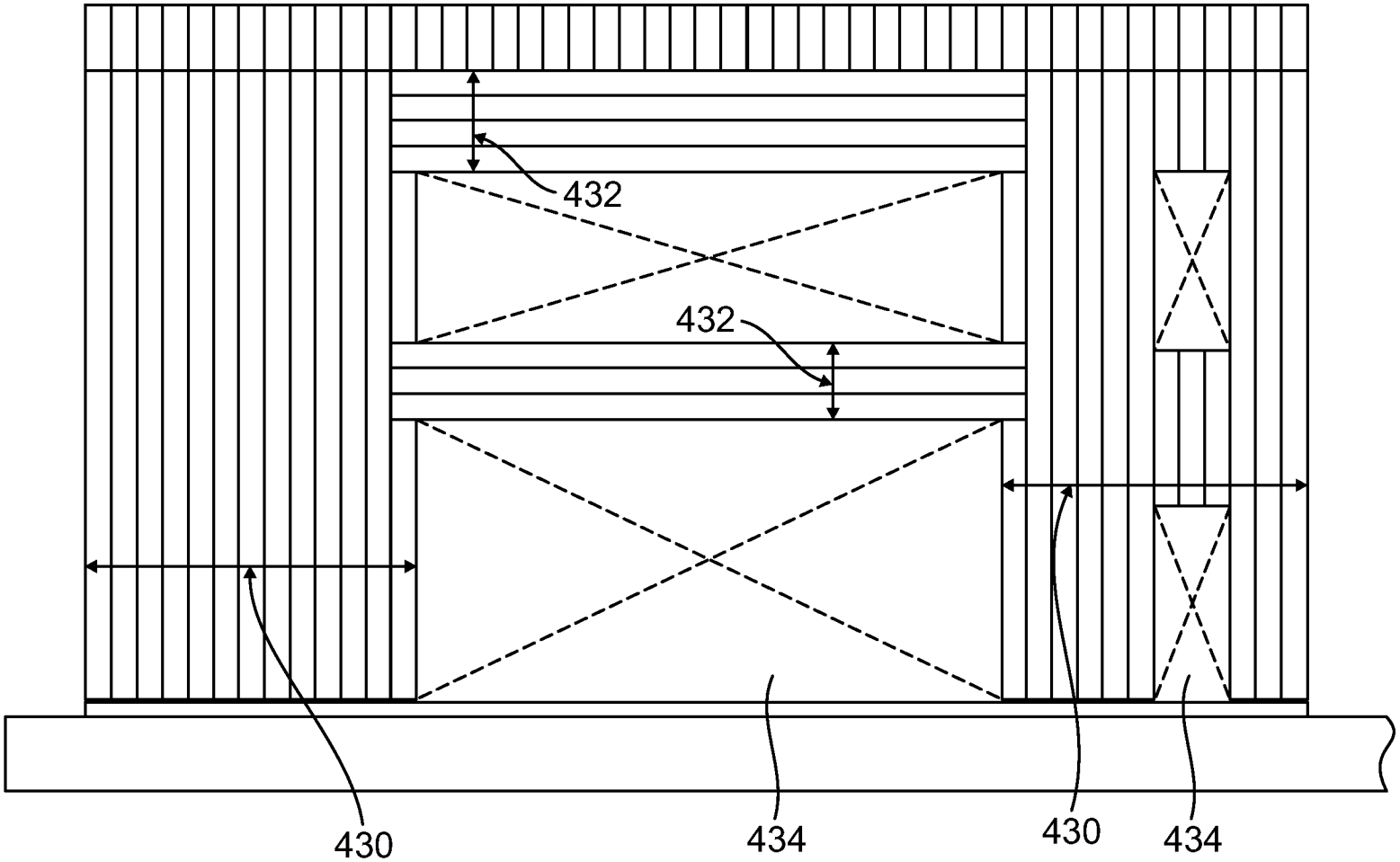
FIG. 4 is a schematic diagram showing use of the prefabricated structural component in an architectural structure, in accordance with an embodiment of the invention.

FIG. 4 is a schematic diagram showing use of the prefabricated structural component in an architectural structure, in accordance with an embodiment of the invention. As can be seen, the prefabricated structural component can comprise a wall element, for example by being assembled together, such as by compressing together air gasket layers as shown in FIG. 3 using lag screws, to form a wall 430. As also shown in FIG. 4, the prefabricated structural component can comprise a column or a beam 432 of the architectural structure. More than one of the prefabricated structural components can together form an opening 434 for at least one of a window and a door.

Figure 5:
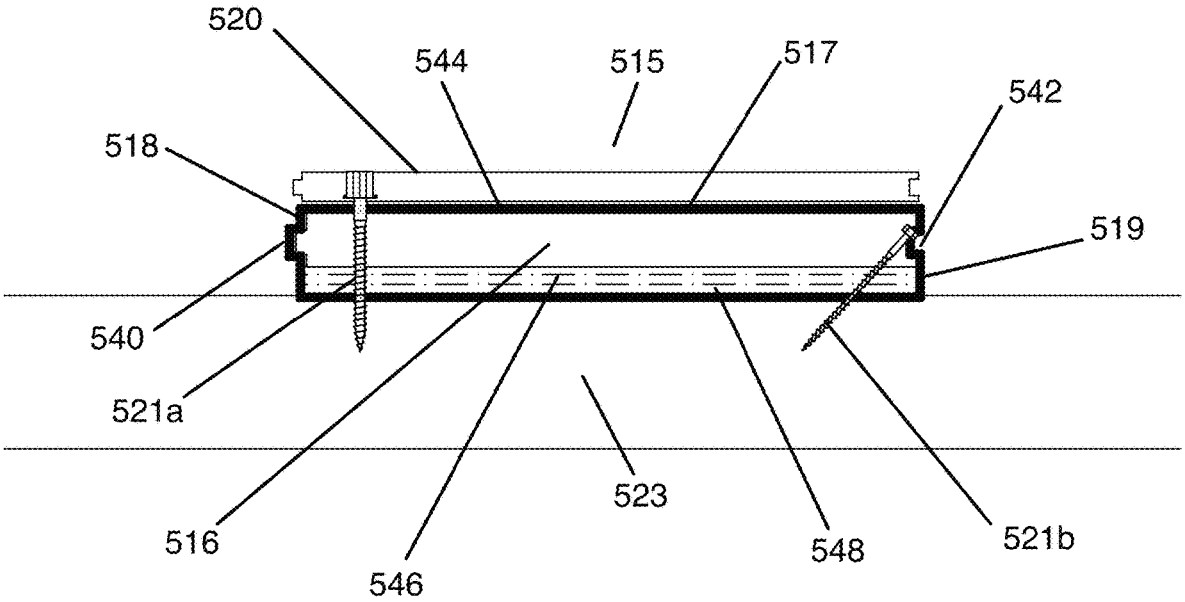
FIG. 5 is an assembled schematic diagram of a prefabricated surface component, in accordance with an embodiment of the invention.
Figure 6:
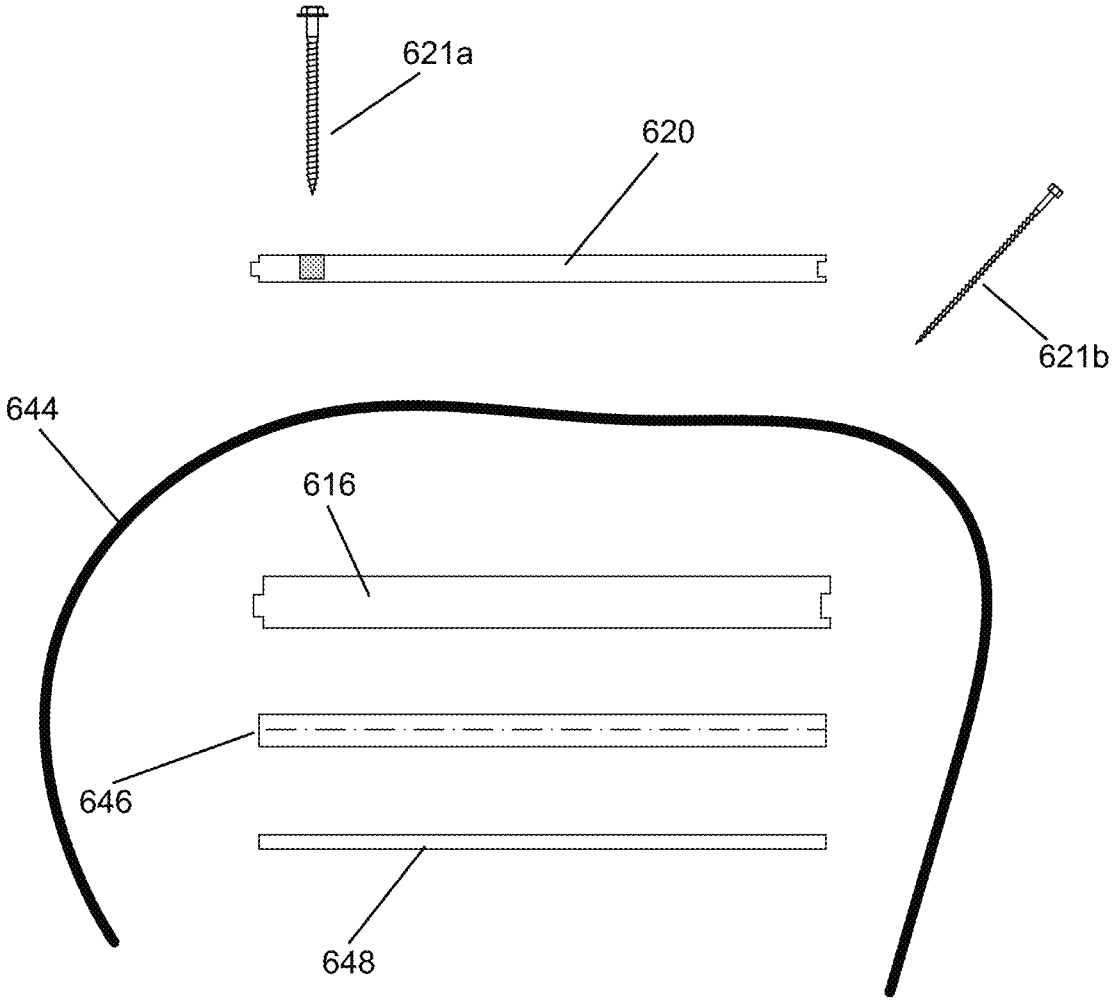
FIG. 6 is an exploded schematic diagram of a prefabricated surface component, in accordance with an embodiment of the invention.
Figure 7:
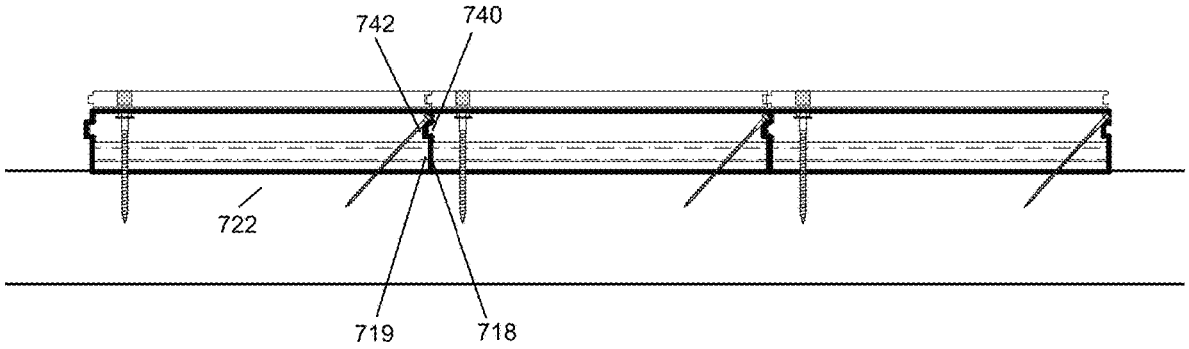
FIG. 7 is schematic diagram of prefabricated surface components assembled together into a surface, in accordance with an embodiment of the invention.

FIG. 5 is an assembled schematic diagram of a prefabricated surface component, such as a hybrid plank floor or roof element, in accordance with an embodiment of the invention. FIG. 6 is an exploded schematic diagram of the prefabricated surface component, in accordance with an embodiment of the invention. FIG. 7 is schematic diagram of the prefabricated surface components assembled together into a surface, in accordance with an embodiment of the invention. A floor or roof element such as that of FIG. 5 can include a sealing gasket air barrier under compression. The floor element completes the air barrier across the floor with a compressed gasket, and can include pre-assembled planks up to 48 feet long or more. A floor or roof joist can be augmented to create a hybrid element that can, for example, add a bottom plate for additional structural capacity, an air barrier (gasket), and/or a finished ceiling. It can provide an integrated acoustical solution, and satisfy fire ratings, to create a one-step floor that works for residential or multi-family codes and criteria.

With reference to the embodiment of FIG. 5, the prefabricated surface component 515 comprises an oriented strand board undersurface layer 516 extending in an elongated dimension to form a plank; a top seal gasket layer 517 on a top surface of the undersurface layer 516; a first edge seal gasket layer 518 on a first side edge of the undersurface layer 516; a second edge seal gasket layer 519 on a second side edge of the undersurface layer 516; and a surface finish layer 520 mounted to the top seal gasket layer 517 of the top surface of the undersurface layer 516. The top seal gasket layer 517, the first edge seal gasket layer 518, and the second edge seal gasket layer 519 can, for example, each comprise an air and vapor control layer, such as a compressible membrane; for example, a foam backed membrane can be used, such as a pro clima® membrane sold by MOLL Bauökologische Produkte GmbH of Schwetzingen, Germany. Further, the top seal gasket layer 517, the first edge seal gasket layer 518, and the second edge seal gasket layer 519 can each comprise a portion of an encapsulating air barrier gasket 544 surrounding at least the oriented strand board undersurface layer 516, which can, for example, be made of such foam backed membrane materials. In an embodiment, the encapsulating air barrier gasket 544 can surround each component of the prefabricated surface component except the surface finish layer 520 and components for attaching it to the prefabricated surface component. In another embodiment, the top seal gasket layer 517, the first edge seal gasket layer 518, and the second edge seal gasket layer 519 can be or include a liquid applied air barrier film. The surface finish layer 520 can, for example, comprise a floor finish, and the oriented strand board undersurface layer 516 can comprise a subfloor layer. The prefabricated surface component 515 can comprise a surface interlock feature 540, such as a tongue feature, which is configured to interlock with a corresponding surface interlock feature 542, such as a groove feature, of a neighboring prefabricated surface component; see also the corresponding surface interlock features 740, 742 in the assembled view of FIG. 7. A lag screw 521*a* can extend through at least a portion of one or more of the surface finish layer 520, the top seal gasket layer 517 and the undersurface layer 516; the lag screw 521*a* can be oriented at an angle between parallel and perpendicular to the top surface of the undersurface layer 516; and the lag screw 521*a* can compress the top seal gasket layer 517 between the surface finish layer 520 and the undersurface layer 516. As shown in the assembled view of FIG. 7, one or more of the first edge seal gasket layer 718 and the second edge seal gasket layer 719 can be compressed against a neighboring prefabricated surface component 722. For example, as shown in FIG. 5, a lag screw 521*b* can extend through one or more of the second edge seal gasket layer 519, the undersurface layer 516 to assist in compressing one or more of the edge seal gasket layers 518 and 519 against a neighboring prefabricated surface component. The lag screws 521*a*, 521*b* can attach the undersurface layer 516 to a truss 523 or a beam in a floor. For example, such a truss 523 or beam can be or include a Timberstrand® LSL Beam, sold by Weyerhaeuser of Seattle, Wash., U.S.A. The prefabricated surface component can further comprise at least one of a thermal control layer 546 and an acoustic control layer 548. The prefabricated surface component can comprise a fire control material. For example, one or more, or all of the components of the prefabricated surface component can comprise or be made of fire safety rated materials satisfying relevant building codes in a locality in which a building is built, or one or more fire safety standards. The surface finish layer 520 can comprise at least one of: a hardwood floor; a porcelain tile; a stone tile; a cement board; a polymer deck; insulation; an exterior finish; and a roof element.

In the exploded view of FIG. 6, there are shown separately example components of the prefabricated surface component, such as the lag screws 621*a* and 621*b*, the encapsulating air barrier gasket 644, the surface finish layer 620, the undersurface layer 616, the thermal control layer 646 and the acoustic control layer 648.

Figure 13:
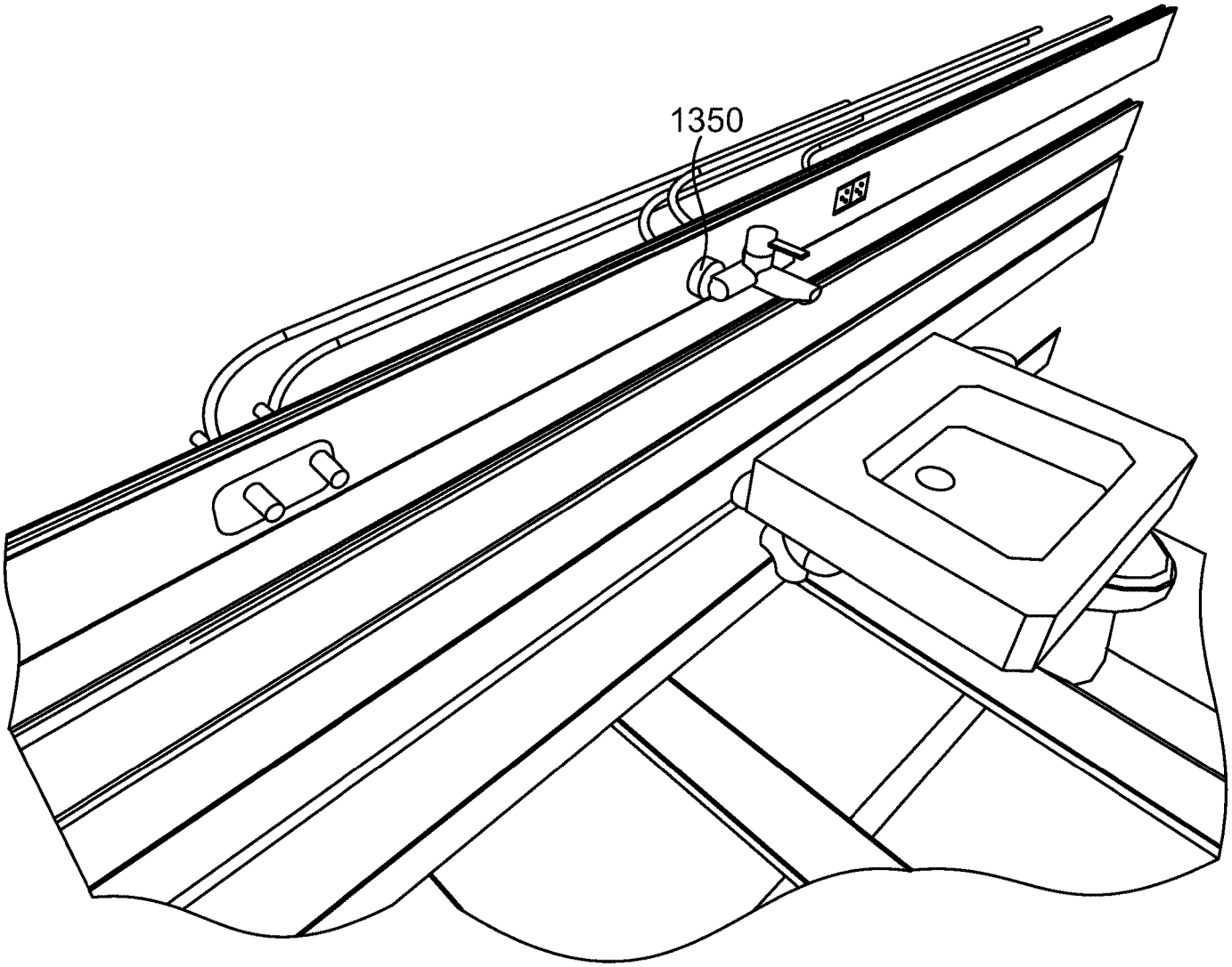
FIG. 13 is a schematic diagram showing a prefabricated surface component that includes plumbing systems installed within openings in the surface component, in accordance with an embodiment of the invention.
Figure 14:
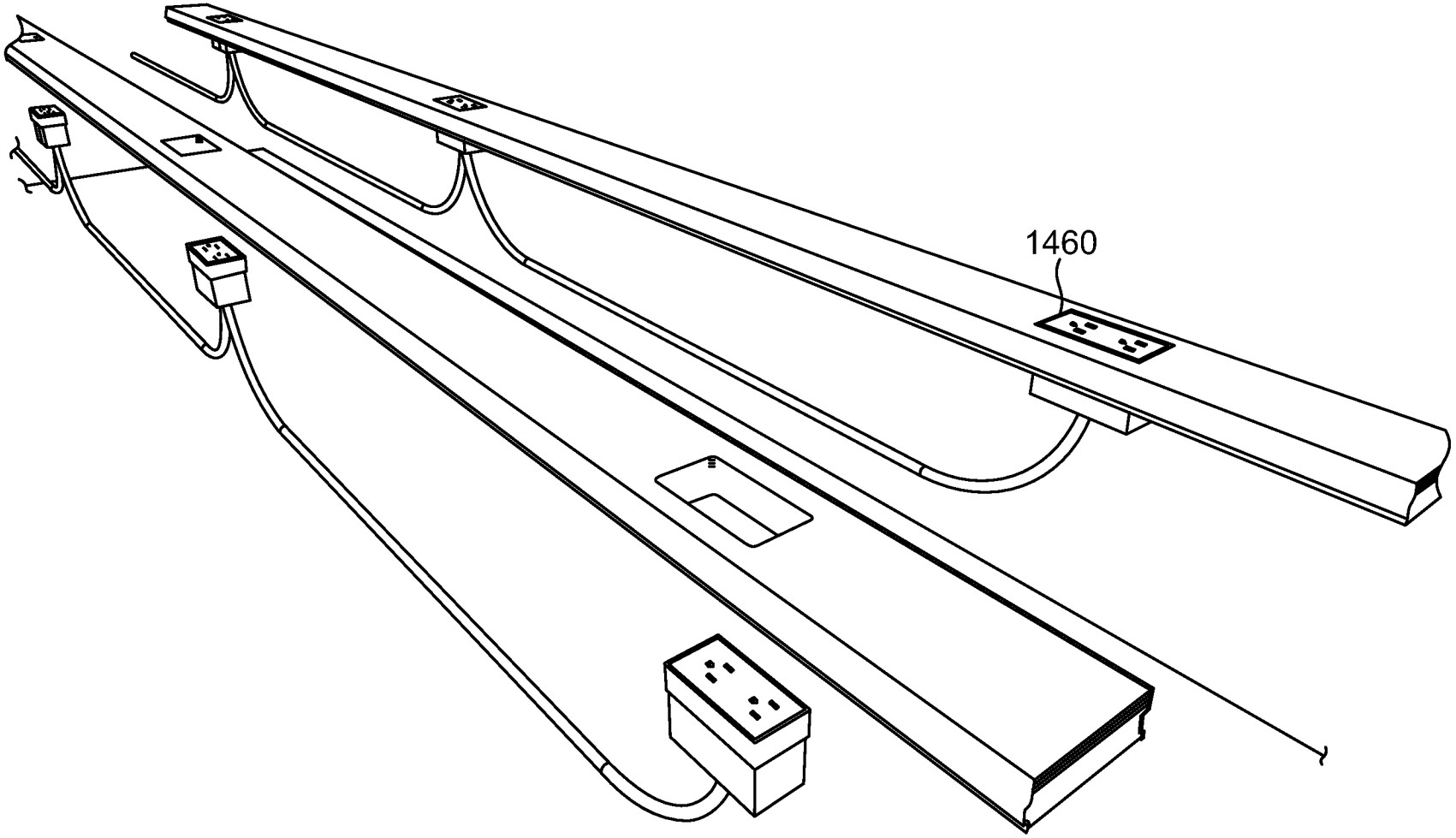
FIG. 14 is a schematic diagram showing a prefabricated surface component that includes electrical systems installed within openings in the surface component, in accordance with an embodiment of the invention.

FIG. 13 is a schematic diagram showing a prefabricated surface component that includes plumbing systems 1350 installed within openings in the surface component, in accordance with an embodiment of the invention; and FIG. 14 is a schematic diagram showing a prefabricated surface component that includes electrical systems 1460 installed within openings in the surface component, in accordance with an embodiment of the invention. As exemplified by FIGS. 13 and 14, the prefabricated surface component can define an opening for at least one of an electrical component (as shown in FIG. 14), a lighting component, a ventilation component, a heating component and a plumbing component (as shown in FIG. 13) to penetrate into or through the prefabricated surface component. The prefabricated surface component can further comprise at least one of a pre-installed electrical component, lighting component, ventilation component, heating component, or plumbing component coupled to the prefabricated surface component, such as being installed in the opening defined in the prefabricated surface component, and can be delivered as such to a work site in which the prefabricated surface component is being used. This can assist in reducing labor in construction of buildings. In addition, a prefabricated surface component can comprise a truss joist pre-attached to the prefabricated surface component, and can be delivered to a work site as such. Further, a prefabricated surface component can comprise ceiling planes attached to a truss, which in turn is attached to the prefabricated surface component, such as a floor component. This can permit easier installation of a suspended ceiling at a work site. For example, the ceiling planes can be hinged or attached by straps to the truss. In another example, the prefabricated surface component can further comprise a pre-installed system coupled to the prefabricated ceiling component and comprising at least one of: a high voltage electrical component; a fire protection system component; a lighting component; and sound insulation. Ceiling system components, such as lighting components, can be transported with the open web floor truss or floor beam, attached to a prefabricated surface component taught herein. Pre-attached systems can, for example, include an HVAC duct, sprinkler heads, smoke detectors, heating components, venting, air conditioning interfaces and lighting tracks. The systems can be attached to the ceiling board and joist, and prefabricated surface component, and carried to the job site as an integrated component. It will also be appreciated that the surface component can include a variety of different possible surfaces, including tile, floor and roof surfaces.

Figure 8:
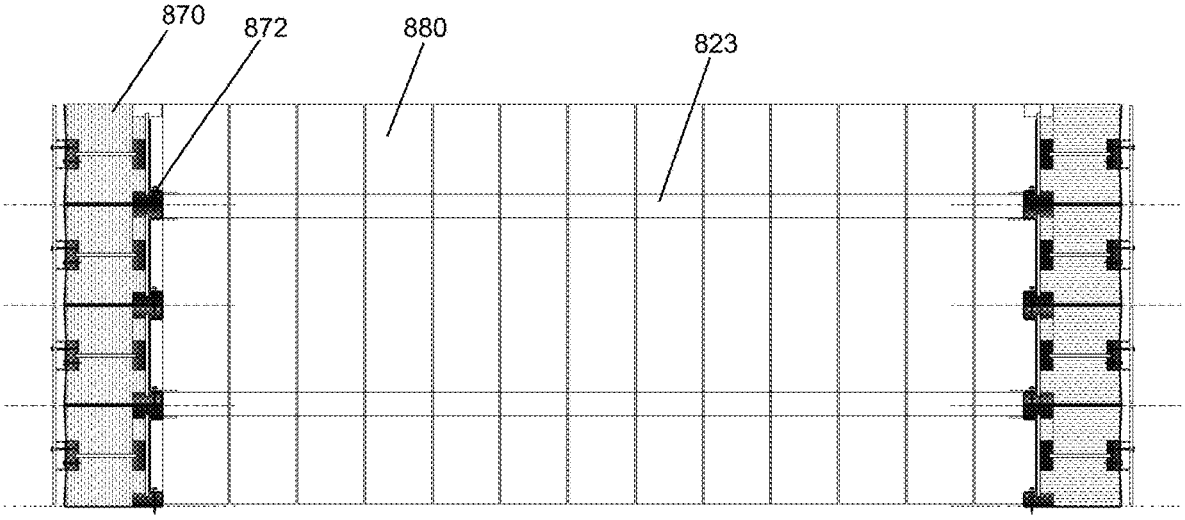
FIG. 8 is a schematic plan view illustrating a method of assembling an architectural structure, in accordance with an embodiment of the invention.

FIG. 8 is a schematic plan view illustrating a method of assembling an architectural structure, in accordance with an embodiment of the invention. An architectural structure is assembled using a prefabricated structural component 870 as taught herein to form structural components, such as exterior walls, roof elements and columns; and the architectural structure is also assembled using the prefabricated surface component 880 as taught herein to form surface components, such as floors and ceilings. The prefabricated structural components 870 and the prefabricated surface components 880 can each be attached to truss or beam elements 823 of the architectural structure. In one example, shown in FIG. 8, the truss or beam element 823 is coupled to a location 872 of a joint between two neighboring prefabricated structural components 870. In one embodiment, a method of assembling an architectural structure comprises forming an exterior shell (such as an exterior wall) of the architectural structure by compressing air barrier gaskets (such as 312 in FIG. 3) between modular increments of the exterior shell of the architectural structure, the modular increments of the exterior shell comprising the prefabricated structural components 870 as taught herein (as in FIG. 8). The method further comprises forming an interior surface (such as an interior floor or ceiling) of the architectural structure by compressing air barrier gaskets (such as 718 and 719 in FIG. 7) between modular increments of the interior surface of the architectural structure, the modular increments of the interior surface comprising prefabricated surface components 880 as taught herein (as in FIG. 8). In this way, by attaching such prefabricated structural components and prefabricated surface components to common truss type connectors and support structures for both the prefabricated structural components and prefabricated surface components, there can be created the incremental or modular accretion of building parts to produce a fully functioning building.

Figure 9:
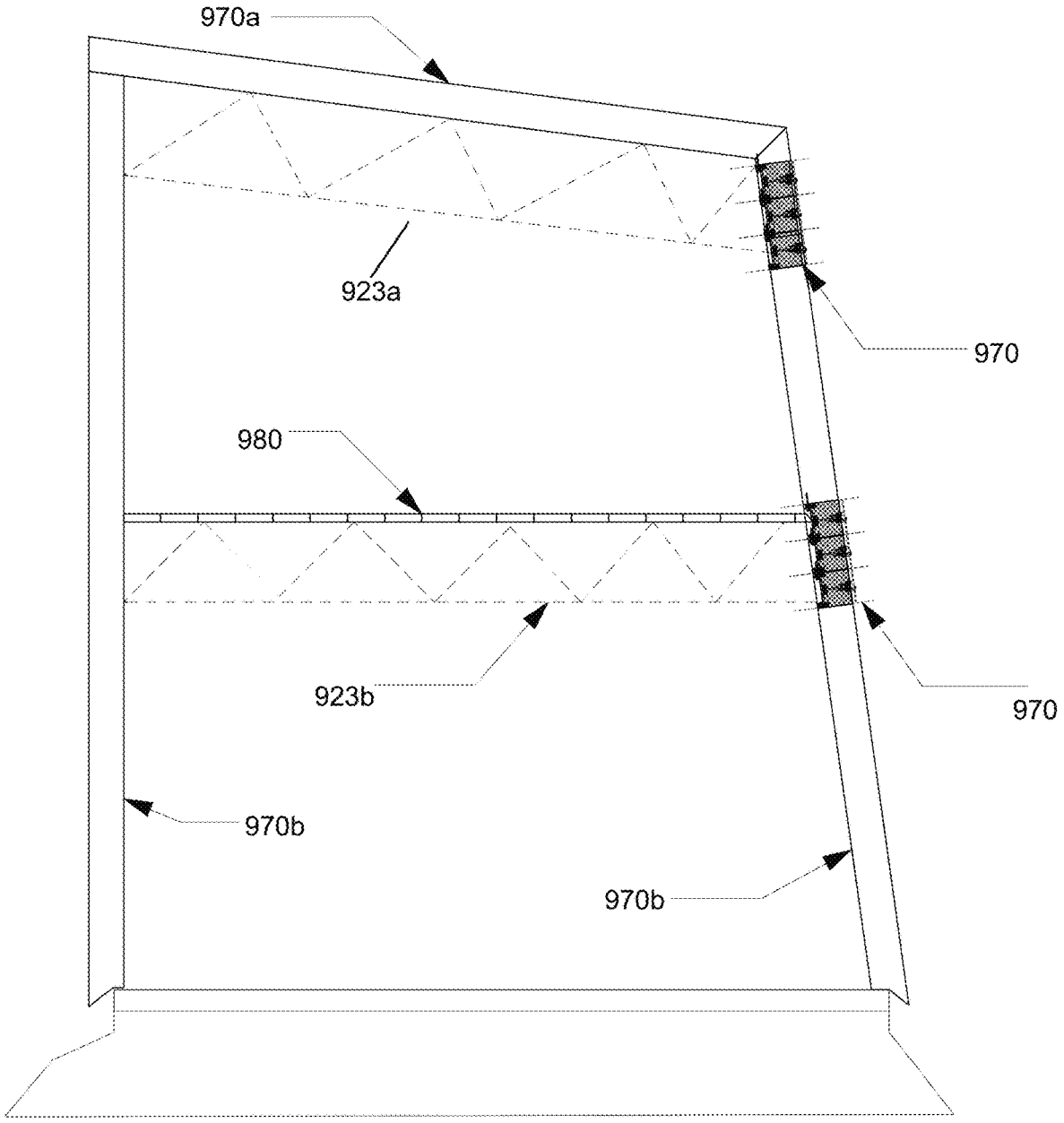
FIG. 9 is a section view of a building created using such a method of assembling an architectural structure in accordance with an embodiment of the invention.

FIG. 9 is a section view of a building created using such a method of assembling an architectural structure in accordance with an embodiment of the invention. The structure includes prefabricated structural components 970 assembled together to serve as roof elements 970*a* and as exterior shell or wall elements 970*b*; prefabricated surface components 980 serving as surfaces such as floors; and truss elements 923*a* supporting the prefabricated structural components 970*a* and at 923*b* supporting the prefabricated surface components 980. Such truss elements 923*a* and 923*b* can, for example, be open-web trusses, such as Red-L™, Red-W™, Red-S™, Red-M™ or Red-H™ trusses, sold by RedBuilt™ of Boise, Id., U.S.A.

Figure 10:
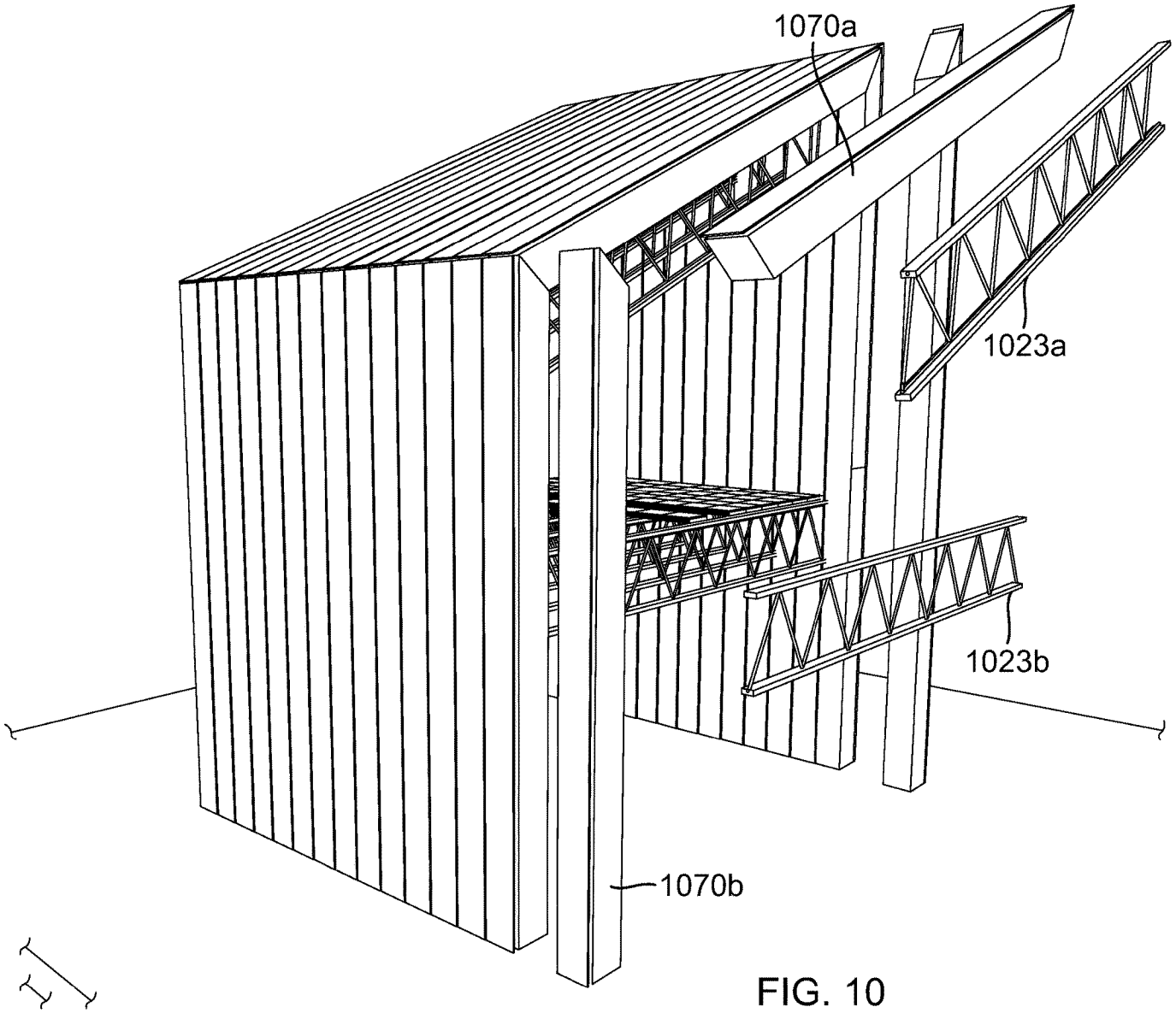
FIG. 10 is a partially exploded projection view of components of the architectural structure of FIG. 9, including prefabricated structural components serving as roof elements, and wall elements, and supporting truss elements.

FIG. 10 is a partially exploded projection view of some of the components of the architectural structure of FIG. 9, including the prefabricated structural components 1070*a* serving as roof elements, 1070*b* serving as wall elements, and the truss elements 1023*a* and 1023*b*. As can be seen, the prefabricated structural components 1070*b* form modular increments of the exterior shell of the architectural structure. Similarly, in FIG. 9, the prefabricated surface components 980 serve as modular increments of the interior surface, such as the floor.

Figure 11:
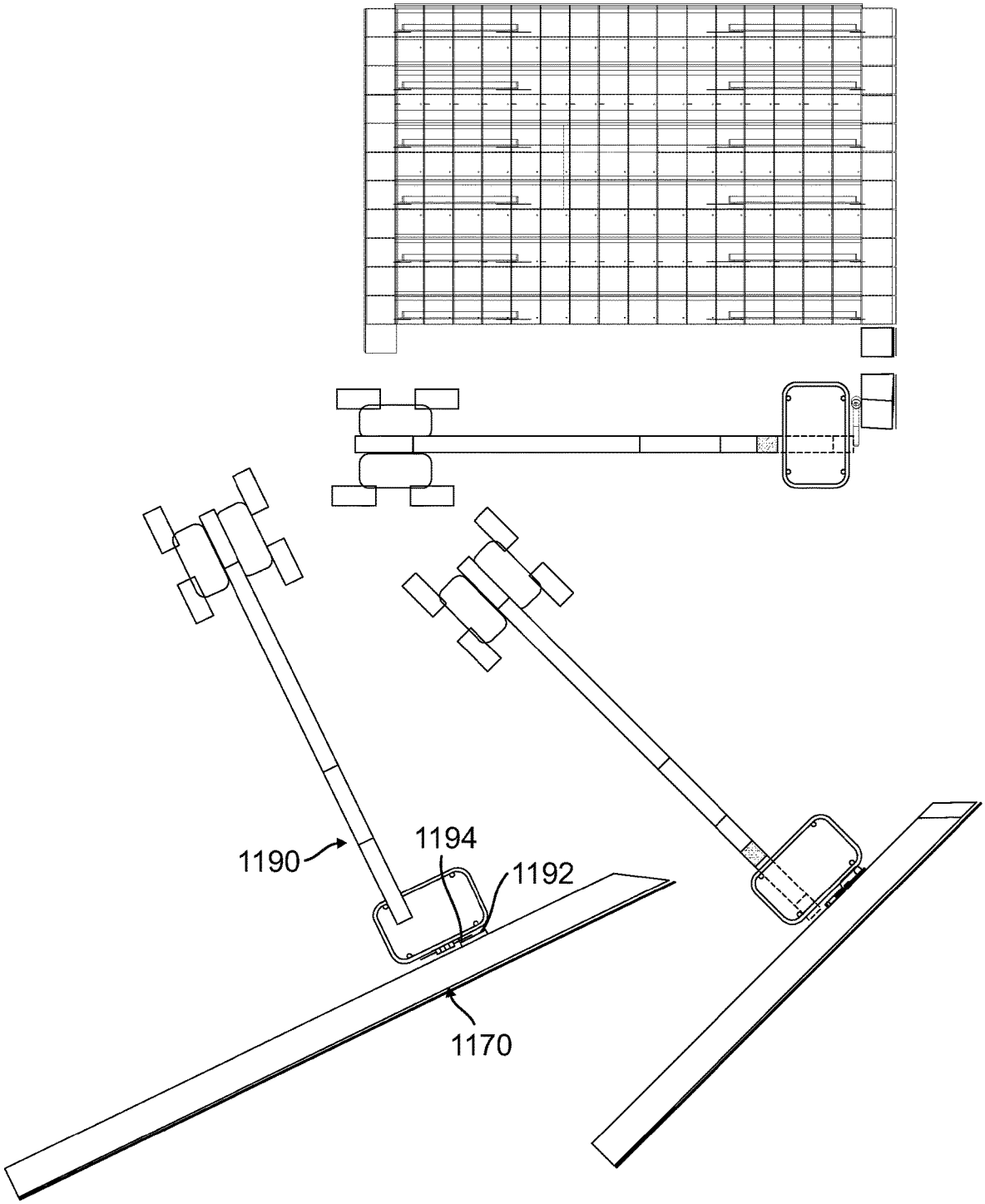
FIG. 11 is a schematic plan view diagram illustrating use of a telescopic handler to lift prefabricated structural components, in accordance with an embodiment of the invention.

FIG. 11 is a schematic plan view diagram illustrating use of a telescopic handler 1190 to lift prefabricated structural components 1170, in accordance with an embodiment of the invention. In this embodiment, the prefabricated structural component 1170 includes a pickup coupling 1192 for the telescopic handler 1190. For example, the pickup coupling 1192 can be an elongated tube, into which a rod 1194 on the telescopic handler 1190 is inserted. Multiple view of the telescopic handler 1190 moving the prefabricated structural component 1170 are shown, to illustrate lifting and positioning of the component 1170 within the structure. It will be appreciated that a similar arrangement can be used for the prefabricated surface component, in which the prefabricated surface component includes a similar pickup coupling for the telescopic handler.

Figure 12:
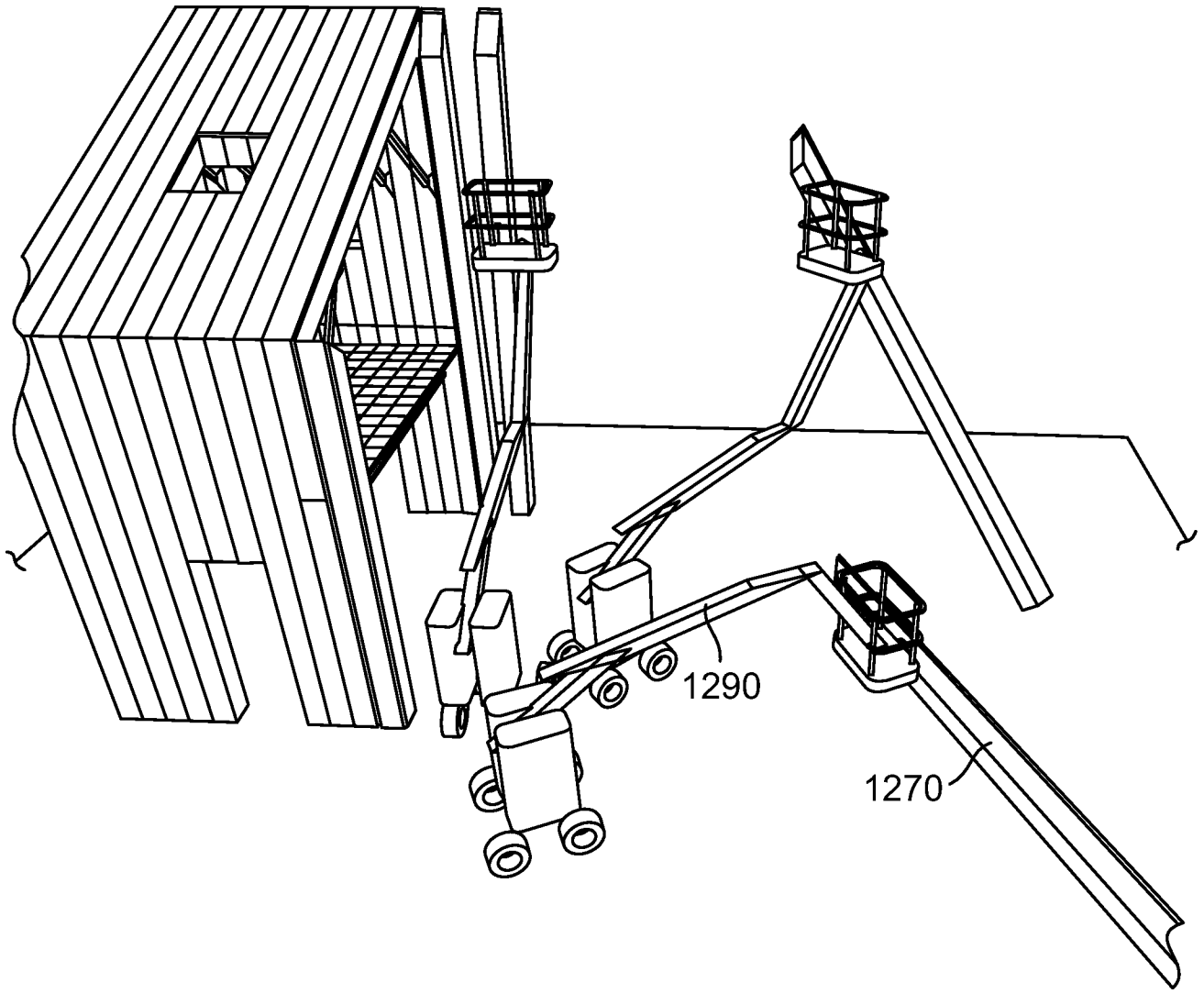
FIG. 12 is a schematic projection view showing use of a telescopic handler to lift prefabricated structural components, in accordance with an embodiment of the invention.

FIG. 12 is a schematic projection view showing use of a telescopic handler 1290 to lift prefabricated structural components 1270, in accordance with an embodiment of the invention. As shown in FIG. 12, the pickup coupling 1192 (of FIG. 11) can be configured to allow the telescopic handler 1290 to lift the prefabricate structural component 1270 into a desired position within the architectural structure, for example by raising the component 1270 from at or near ground level to an orientation and position within the architectural structure, such as a vertical orientation in a desired position in a wall, or at a desired angle in a roof. A similar arrangement can be used for the prefabricated surface component.

Prefabricated components in accordance with embodiments described herein, can be used in a variety of flexible ways in building an architectural structure. Angled roofs can be created, as can open spaces between prefabricated wall components in which a window or door may be placed. Gutters, eaves and other components can also be integrated with prefabricated components taught herein. Ceiling joists taught above can be joined together to form a full suspended ceiling. Connecting plates can be used to form an angled connection between prefabricated structural components, for example to be used as a wall component and a roof component. Prefabricated energy-efficient louvered windows can be used with prefabricated wall components taught herein. Prefabricated sets of stairs can be attached to a prefabricated structural or surface component as taught above and can be brought as a single unit to a job site. Prefabricated window boxes can be installed as units with prefabricated components taught above. Such a box or buck that houses a window or door can allow for a modular continuous air barrier connection between the wall and windows and doors. The window and doors can be loaded into the buck after installation of the buck, or lighter units can be installed prior to installation of the buck.

Prefabricated structural components and surface components taught herein can be capable of manipulation by a computer aided manufacturing (CAM) process that can cut the element at various angles to create more complex geometries. Planes at the ends of the component can be formed by a cutting path of a saw controlled by a CAM process, for example. External finish can be cut separately.

A complex building shape can be built using prefabricated components taught herein, such as a hipped roof building, in which the prefabricated structural components are pre-shaped into the desired form, such as an increment of a hipped roof. Conventionally such a building would be built in a different way with long hip rafters that follow the lines of the hip. Joists can then be used to fill in between the structural lines that define the roof shape.

In embodiments, a technique of incremental building can use prefabricated components taught herein. A linear type of building involves incrementally using such components, layer by layer. Windows fit into the incrementally-built system with an open wall at the end and inserted windows along the axis of the structure. A rail on the ground can be used to establish a precise build line and allow for an extension of the building. The building could be easily and quickly extended or contracted by removing segments, and even selling the parts. This would produce a more dynamic life cycle to a building that distributes cost differently for infrastructure and allows for contraction and disposal in new ways. Here, a business concern could grow their business and buildings in parallel, avoiding errors in predicting growth and also avoid the disruption and expense of standard construction as extending increments of building would logistically much easier. Adding warehouse area or office area can, for example, be performed using such expansion. The building can also be extensible based on stories, with upper stories extending independently to some extent to other stories; and can also extend along a non-linear path such as a curve eventually building a complete circle.

In an embodiment according to the invention, prefabricated components taught herein can include an engineered truss joist, which is superior to conventional dimensional lumber. For example, prefabricated components taught herein can include truss joists, or other elements, made of oriented strand board (OSB). In addition, prefabricated structural components and prefabricated surface components taught herein can be joined together using lag screws, which have highly advantageous structural capabilities. These lag screws can be installed using impact drivers, which drive screws easily and powerfully into thick hardwoods. In addition, prefabricated components in accordance with an embodiment of the invention can include a gasketed air barrier, which can use a liquid or tape and film membrane. Where air barriers are used in embodiments herein, they may, for example, use a product such as the ExoAir™ 110/110LT or other ExoAir™ membranes sold by Georgia-Pacific LLC of Atlanta, Ga., U.S.A. Where exterior finishes are used in embodiments herein, they may, for example, use a product such as FunderMax Exterior, F-Quality, sold by FunderMax Holding AG of Wiener Neudorf, Austria. Where lag screws or powerlag screws are used in embodiments herein, they may, for example, use a product such as SPAX® PowerLag® screws, sold by Altenloh, Brinck & Co. U.S., Inc., of Bryan, Ohio, U.S.A. Such lag screws or powerlag screws can be installed using an impact driver, such as, for example, an 18V LXT® Lithium-ion Sub-Compact Brushless Cordless Impact Driver Kit (2.0 Ah) sold by Makita Corporation of Anjo, Aichi, Japan. Where open-web trusses are used in embodiments herein, they may, for example, use Red-L™, Red-W™, Red-S™, Red-M™ or Red-H™ trusses, sold by RedBuilt™ of Boise, Id., U.S.A. As a backing material for multi-function surfaces used in embodiments herein, there may be used the Timberstrand® LSL Beam, sold by Weyerhaeuser of Seattle, Wash., U.S.A. Where truss joists or I-joists are used in embodiments herein, there may be used the TrusJoist® TJI® Joist sold by Weyerhaeuser of Seattle, Wash., U.S.A. Where thermal insulation is used in embodiments herein, there may be used the Gutex® Multitherm® wood fiberboard insulation, sold by H. Henselmann GmbH+Co KG of Waldshut-Tiengen, Germany. It will be appreciated that a variety of other possible products can be used, in accordance with the teachings herein.

In accordance with an embodiment of the invention, mass production of prefabricated components taught herein can be used to yield high precision components and high precision installations, based on a direct CAD/CAM process, in which an architect's or designer's CAD system is used to fashion physical parts, which are then sent to a CAM environment, if custom made parts are to be used; or to an order sheet, if the designs are to be used to select stock parts. A purchase order sent from the designer's work screen eliminates many middlemen. An owner can then contract with an assembler or other laborer to assemble the building components, or perform the labor him or herself (do it yourself, or DIY, labor) as necessary. The use of contractors can be reduced or eliminated, while a construction consultant can, in a few hours, manage construction means and methods and point to the most cost effective and safest way to perform installation of the project.

Using components in accordance with an embodiment of the invention, several advantages may be provided, without limitation. Walls and other distinct parts of conventional construction are subsumed in one system panel. No special differentiated components are necessary to create new beams, headers, sills and posts. The system module can be used with standardized dimensions such as, for example 16 inches by 16 inches or 18 inches by 18 inches. These standardized system modules can be used for "automatic" building by readily permitting contiguous panel attachment using lag screws. All parts can be side coated with a rubberized coating, in order to instantly and effectively create a tight gasket in compression, for a complete and successful air and vapor barrier. Precision panel components can be created, for example using 48 foot long standard true joist components. Installation can be performed with low skills, in a way that is safer than conventional methods. Screws are used for the assembly, rather than nails, which increases safety. Owner participation in the building process can be greatly increased, including permitting do-it-yourself home building. The building envelope can be installed quickly using the wall components, and, using the gasketed floor planks, a complete building air barrier envelope can be quickly created. Mass production of the component modules can be made inexpensive and simple, by adding value to a truss joist product. A linear production line can be made, using components up to 60 feet long or more.

In addition, embodiments according to the invention can provide other advantages, without limitation. The system can serve modern and contemporary architecture well, by providing a precision system capable of creating longer spans more easily, and higher ceilings. No site cutting is required, so that the installation is labor-controlled; all precut or modular parts are ordered before site work commences. Robust parts are capable of installation and de-installation. Simple relief structures are set up quickly and break down quickly. The system is also essentially waterproof, and its hurricane resistant properties may be advantageous in hurricane-prone areas. No inaccessible wall cavities are involved, which create mold potential in conventional structures.

While example embodiments have been particularly shown and described, it will be understood by those skilled in the art that various changes in form and details may be made therein without departing from the scope of the embodiments encompassed by the appended claims.

What is claimed is:

1. A prefabricated structural component for construction of a building, the prefabricated structural component comprising:

a first joist comprising a substantially planar central web section, the central web section being joined at a first edge by a first flange oriented perpendicular to the central web section, and the central web section being joined at a second edge by a second flange oriented perpendicular to the central web section;

a first air barrier gasket on an exterior edge of the first flange of the first joist, the exterior edge of the first flange being opposite to an interior edge of the first flange that is joined to the central web section;

a second air barrier gasket on an exterior edge of the second flange of the first joist, the exterior edge of the second flange being opposite to an interior edge of the second flange that is joined to the central web section;

a second joist, perpendicular to the central web section of the first joist and attached by a first flange of the second joist to the central web section of the first joist, the second joist further including a second flange, the first flange and second flange of the second joist being perpendicular to a substantially planar central web section of the second joist; and an exterior finish layer, mounted to an exterior edge of the second flange of the second joist, and being oriented in a direction perpendicular to the central web section of the second joist and parallel to the central web section of the first joist the first air barrier gasket and the second air barrier gasket each comprising a portion of an encapsulating air barrier gasket surrounding at least the first joist and the second joist.

2. The prefabricated structural component of claim 1, further comprising:

thermal insulation in at least one space between the central web section of the first joist, the central web section of the second joist and the exterior finish layer.

3. The prefabricated structural component of claim 1, further comprising:

a lag screw extending through the at least one flange of the first joist and into a flange of a joist of a neighboring prefabricated structural component of claim 1 to secure the prefabricated structural component to the neighboring prefabricated structural component.

4. The prefabricated structural component of claim 3, wherein the lag screw is positioned and operatively installed to compress the air barrier gasket on the exterior edge of at least one of the flanges of the first joist to create a seal between the first joist and the joist of the neighboring prefabricated structural component.

5. The prefabricated structural component of claim 1, wherein the prefabricated structural component comprises a wall element.

6. The prefabricated structural component of claim 1, wherein the prefabricated structural component comprises a column or a beam of an architectural structure.

7. The prefabricated structural component of claim 1, further comprising more than one of the prefabricated structural component, the more than one prefabricated structural components together forming an opening for at least one of a window and a door.

8. The prefabricated structural component of claim 1, further comprising a pickup coupling for a telescopic handler.

9. The prefabricated structural component of claim 1, wherein the exterior finish layer comprises a bulk water control layer.

10. The prefabricated structural component of claim 1, wherein the first air barrier gasket and the second air barrier gasket each comprise an air and vapor control layer.

11. The prefabricated structural component of claim 1, wherein the prefabricated structural component comprises at least one of fire control materials and acoustic control materials.

12. A method of assembling an architectural structure, the method comprising:

forming an exterior shell of the architectural structure by compressing air barrier gaskets between modular increments of the exterior shell of the architectural structure, the modular increments of the exterior shell comprising prefabricated structural components; and forming an interior surface of the architectural structure by compressing air barrier gaskets between modular increments of the interior surface of the architectural structure, the modular increments of the interior surface comprising prefabricated surface components;

wherein the prefabricated structural components comprise:

a first joist comprising a substantially planar central web section, the central web section being joined at a first edge by a first flange oriented perpendicular to the central web section, and the central web section being joined at a second edge by second flange oriented perpendicular to the central web section;

a first air barrier gasket on an exterior edge of the first flange of the first joist, the exterior edge of the first flange being opposite to an interior edge of the first flange that is joined to the central web section;

a second air barrier gasket on an exterior edge of the second flange of the first joist, the exterior edge of the second flange being opposite to an interior edge of the second flange that is joined to the central web section;

a second joist, perpendicular to the central web section of the first joist and attached by a first flange of the second joist to the central web section of the first joist, the second joist further including a second flange, the first flange and second flange of the second joist being perpendicular to a substantially planar central web section of the second joist; and an exterior finish layer, mounted to an exterior edge of the second flange of the second joist, and being oriented in a direction perpendicular to the central web section of the second joist and parallel to the central web section of the first joist;

the first air barrier gasket and the second air barrier gasket each comprising a portion of an encapsulating air barrier gasket surrounding at least the first joist and the second joist.

13. The method of claim 12, wherein the prefabricated surface components further comprise:

an oriented strand board undersurface layer extending in an elongated dimension to form a plank;

a top seal gasket layer on a top surface of the undersurface layer;

a first edge seal gasket layer on a first side edge of the undersurface layer;

a second edge seal gasket layer on a second side edge of the undersurface layer; and a surface finish layer mounted to the top seal gasket layer of the top surface of the undersurface layer.

* * * * *